US008510121B2

(12) United States Patent
Zhan et al.

(10) Patent No.: US 8,510,121 B2
(45) Date of Patent: Aug. 13, 2013

(54) MULTIPLE DESCRIPTION AUDIO CODING AND DECODING METHOD, APPARATUS, AND SYSTEM

(75) Inventors: Wuzhou Zhan, Shenzhen (CN); Zhiyong Yang, Shenzhen (CN)

(73) Assignee: Huawei Device Co., Ltd., Shenzhen (CN)

( * ) Notice: Subject to any disclaimer, the term of this patent is extended or adjusted under 35 U.S.C. 154(b) by 53 days.

(21) Appl. No.: 13/361,580

(22) Filed: Jan. 30, 2012

(65) Prior Publication Data

US 2012/0130722 A1 May 24, 2012

Related U.S. Application Data

(63) Continuation of application No. PCT/CN2010/074052, filed on Jun. 18, 2010.

(30) Foreign Application Priority Data

Jul. 30, 2009 (CN) ..... 2009 1 0089957

(51) Int. Cl.
*G10L 19/02* (2013.01)

(52) U.S. Cl.
USPC ..... 704/500; 704/205

(58) Field of Classification Search
None
See application file for complete search history.

(56) References Cited

U.S. PATENT DOCUMENTS 6,253,185 B1 * 6/2001 Arean et al. ..... 704/500
7,356,748 B2 * 4/2008 Taleb ..... 714/746
7,929,601 B2 * 4/2011 Vitali et al. ..... 375/240.03
8,279,947 B2 * 10/2012 Zhan ..... 375/242
2007/0150272 A1 6/2007 Cheng et al.
2010/0091901 A1 4/2010 Zhan

FOREIGN PATENT DOCUMENTS

CN 101115051 A 1/2008
CN 101340261 A 1/2009
EP 1 041 756 A2 10/2000
EP 1 158 494 A1 11/2001
WO 2005/051001 A2 6/2005

OTHER PUBLICATIONS

International Search Report issued in corresponding PCT Application No. PCT/CN2010/074052; mailed Sep. 23, 2010.
Written Opinion of the International Searching Authority issued in corresponding PCT Application No. PCT/CN2010/074052; mailed Sep. 23, 2010.

(Continued)

*Primary Examiner* — Talivaldis Ivars Smits
(74) *Attorney, Agent, or Firm* — Brinks Hofer Gilson & Lione

(57) ABSTRACT

Embodiments of the present invention provide a multiple description audio coding and decoding method, apparatus, and system. The audio coding method includes: dividing residual signals indicating current audio signal information into multiple frequency band parts having different frequencies; respectively coding the multiple frequency band parts by using multiple description coding (MDC) methods with different speech quality; and combining each of description signal parts that are generated after coding is performed by using different MDC methods to form multiple description bit streams of the residual signals. According to the present invention, multiple description coding and decoding methods with different speech quality are used for different frequency bands, which reduces the bit rate of multiple description coding and decoding, improves the effect of multiple description coding and decoding, and hence enhances the quality of audio transmission.

19 Claims, 8 Drawing Sheets

(56) References Cited

OTHER PUBLICATIONS

Supplementary European Search Report issued in corresponding European Patent Application No. 10 80 3862; dated May 16, 2012.

Zhang, Yang et al. Overview of Reseaches on Multiple Description Coding, Chinese Journal of Computers. Sep. 2007:1612-1624.

Zhang, Xin "Research and Implementation of Anti Packet Loss Wideband Audio Coding Algorithms", Chinese Master's Theses Full-txt Database information Science and Technology, Jan. 15, 2009:1136-98.

Liu, Jieping et al. "Integrated Application of Multiple Description Coding and Error Concealment in Image Transmission," Computer Applications and Software Sep. 2005:15-16.

Office Action issued in corresponding European Patent Application No. 10803862.1, mailed Dec. 3, 2012.

* cited by examiner

MULTIPLE DESCRIPTION AUDIO CODING AND DECODING METHOD, APPARATUS, AND SYSTEM

CROSS-REFERENCE TO RELATED APPLICATIONS

This application is a continuation of International Application No. PCT/CN2010/074052, filed on Jun. 18, 2010, which claims priority to Chinese Patent Application No. 200910089957.7, filed on Jul. 30, 2009, both of which are hereby incorporated by reference in their entireties.

FIELD OF THE INVENTION

The present invention relates to the field of communications technologies, and in particular, to a multiple description audio coding and decoding method, apparatus, and system.

BACKGROUND OF THE INVENTION

With rapid development of the Internet Protocol (IP) network and mobile network technologies and improvement of coding quality and efficiency brought by audio coding and decoding technologies, high quality audio services are quickly converging in modern communication systems. However, in a packet-switched communication system, the issues of packet loss and long network delay are inevitable due to network congestion, channel interference, and noise. Quality of audio information transmission over the IP network and mobile communication system is severely affected by the packet loss and network delay.

Multiple description coding (MDC) is an information source coding technology for transmitting information over an unreliable network. With the MDC technology, multiple transmission bit streams are generated and redundancy is introduced in each of the bit streams without increasing the network delay, and therefore a stable information source coding algorithm with packet loss concealment capabilities is provided. The general idea of MDC is performing multiple description analysis and synthesis based on original audio signal processing: dividing the original audio signals into mutually-independent masking threshold signals and residual signals; transmitting the residual signals indicating information about the original audio signals and the masking threshold to a multiple description encoder for MDC to obtain two descriptions that can be processed separately or jointly; and respectively coding and decoding the masking threshold and residual signals based on quantization and coding by using a double description method. In case of severe packet loss, error concealment can be implemented for packet loss according to the history records of different descriptions. This technical solution can effectively solve the problem of quality deterioration caused by packet loss during the transmission of audio streams.

FIG. 1 is a schematic diagram of a coding process of a multiple description encoder in the prior art. As shown in FIG. 1, a masking threshold and residual signals are coded by using multiple description methods respectively to obtain two descriptions. The MDC algorithm may be a multiple description scalar quantization (MDSQ) algorithm, or a multiple description transform coding (MDTC) algorithm, or a multiple description vector quantization (MDVQ) algorithm. Because residual signals account for about 80% of the bit rate, and the data volume of the masking threshold is smaller than the data volume of the residual signals, the MDC for the masking threshold may also be implemented by direct copying. To be specific, masking threshold descriptions 1 and 2 shown in FIG. 1 are the same. After MDC for the masking threshold and residual signals, masking threshold description 1 and residual signal description 1 are combined in combiner 1 to form description 1; masking threshold description 1 and residual signal description 2 are combined in combiner 2 to form description 2.

In the technical solution of the prior art, there is more than one description bit stream and some redundant information is added in each bit stream. As a result, the redundancy of the bit rate is high. For example, in case of double description coding, as compared with the case that no multiple description encoder is used, the bit rate is increased by 50%. This impairs the effect of multiple description coding and decoding and reduces audio transmission performance.

SUMMARY OF THE INVENTION

Embodiments of the present invention provide a multiple description audio coding and decoding method, apparatus, and system, which can reduce the bit rate of the multiple description audio coding and decoding, improve the effect of multiple description audio coding and decoding, and hence enhance the quality of audio transmission.

An embodiment of the present invention provides a multiple description audio coding method, including:

dividing residual signals indicating current audio signal information into multiple frequency band parts having different frequencies;

respectively coding the multiple frequency band parts by using MDC methods with different speech quality; and combining each of description signal parts that are generated after coding is performed by using different MDC methods to form multiple description bit streams of the residual signals.

An embodiment of the present invention provides a multiple description audio decoding method, including:

dividing received multiple description bit streams of residual signals into multiple description signal parts having different frequencies;

decoding the multiple description signal parts having different frequencies by using multiple description methods to obtain residual signal parts having different frequencies; and combining the obtained residual signal parts having different frequencies to obtain residual signals indicating audio signal information through reconstruction.

An embodiment of the present invention provides a multiple description audio coding apparatus, including:

a frequency band dividing unit, configured to divide residual signals indicating current audio signal information into multiple frequency band parts having different frequencies;

an MDC unit, configured to code the multiple frequency band parts divided by the frequency band dividing unit by using MDC methods with different speech quality; and a bit stream combining unit, configured to combine the description signal parts coded and generated by the MDC unit by using the different MDC methods to form multiple description bit streams of the residual signals.

An embodiment of the present invention provides a multiple description audio decoding apparatus, including:

a frequency signal dividing unit, configured to divide received multiple description bit streams of residual signals into multiple description signal parts having different frequencies;

a multiple description decoding unit, configured to decode the multiple description signal parts having different frequencies by using multiple description methods to obtain residual signal parts having different frequencies; and a signal combining unit, configured to combine the obtained residual signal parts having different frequencies to obtain residual signals indicating audio signal information through reconstruction.

An embodiment of the present invention also provides a multiple description audio coding and decoding system, including the multiple description audio coding apparatus and multiple description audio decoding apparatus.

According to the above technical solution provided in the present invention, the coding method includes: dividing residual signals indicating current audio signal information into multiple frequency band parts having different frequencies; respectively coding the multiple frequency band parts by using MDC methods with different speech quality; and combining each of description signal parts that are generated after coding is performed by using different MDC methods to form multiple description bit streams of the residual signals. In this manner, MDC methods with different speech quality are used for different frequency bands, which reduces the bit rate of multiple description coding and decoding, improves the effect of multiple description coding and decoding, and hence enhances the quality of audio transmission.

BRIEF DESCRIPTION OF THE DRAWINGS

To make the technical solution provided in embodiments of the present invention or the prior art clear, the accompanying drawings for illustrating the embodiments of the present invention or the prior art are briefly described below. Apparently, the accompanying drawings are exemplary only, and persons skilled in the art can derive other drawings from such accompanying drawings without any creative effort.

DETAILED DESCRIPTION OF THE EMBODIMENTS

The technical solutions provided in embodiments of the present invention are described clearly and completely with reference to the accompanying drawings. Evidently, the embodiments are exemplary only, without covering all embodiments of the present invention. Persons skilled in the art can derive other embodiments from the embodiments provided herein without making any creative effort, and all such embodiments are covered in the scope of the present invention.

Embodiments of the present invention provide a multiple description audio coding method, apparatus, and system. According to the present invention, MDC methods with different speech quality are used for different frequency bands, which reduces the bit rate of multiple description coding, improves the effect of multiple description coding, and hence enhances the quality of audio transmission.

Embodiment 1

Figure 1:
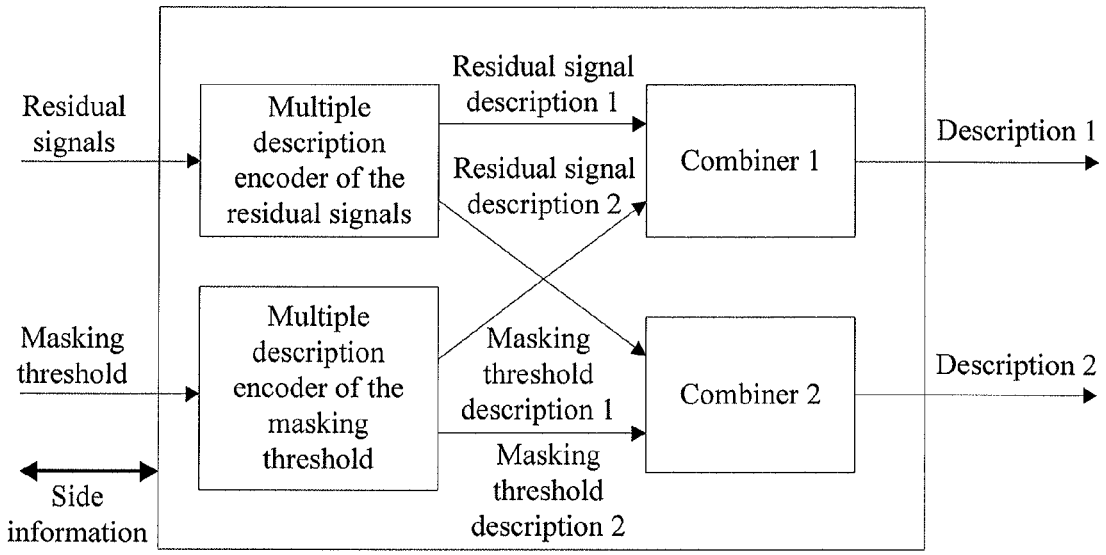
FIG. 1 is a schematic diagram of a coding process of a multiple description encoder in the prior art.
Figure 2A:
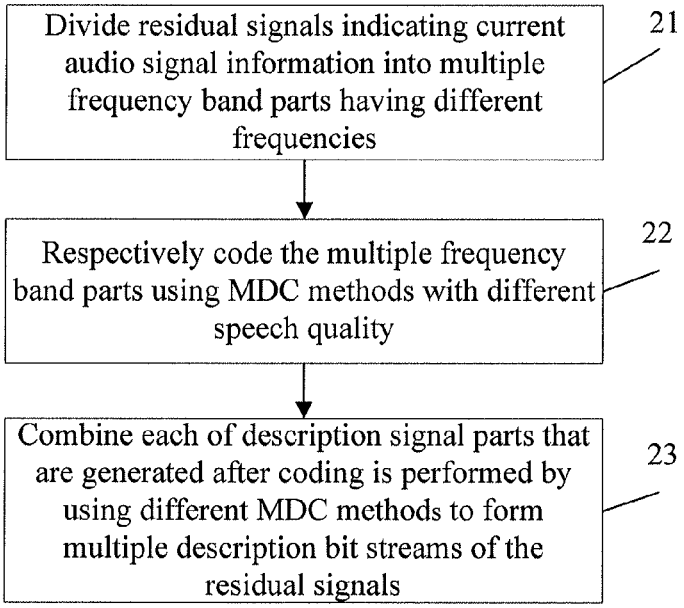
FIG. 2*a* is a schematic flowchart of a multiple description audio coding method according to Embodiment 1 of the present invention.

Embodiment 1 of the present invention provides a multiple description audio coding method. FIG. 2*a* is a schematic flowchart of the multiple description audio coding method according to this embodiment. The method includes the following steps:

Step 21: Divide residual signals indicating current audio signal information into multiple frequency band parts having different frequencies.

In step 21, residual signals indicating current audio signal information are divided into multiple frequency band parts having different frequencies. During specific implementation, the frequency band parts may be set by operation personnel based on actual requirements or the residual signals may be divided according to preset frequency thresholds.

The process of dividing the residual signals according to preset frequency thresholds may be specifically as follows: setting multiple frequency thresholds, for example, two or three frequency thresholds in ascending order, and dividing the residual signals into multiple frequency band parts according to the set multiple frequency thresholds.

For example, if two frequency thresholds are set, the residual signals may be divided into three frequency band parts; if three frequency thresholds are set, the residual signals may be divided into four frequency band parts. The number of frequency thresholds and the number of frequency band parts that the residual signals are to be divided into may be determined according actual use requirements.

Step 22: Code each of the multiple frequency band parts by using MDC methods with different speech quality.

In step 22, after the residual signals are divided into multiple frequency band parts, each of the frequency band parts may be coded by using multiple description methods with different speech quality. During specific implementation, human ears are sensitive to a low-frequency part and less sensitive to a high-frequency part. Therefore, considering speech quality and bit rate redundancy, a low-frequency part obtained by dividing the residual signals may be coded by using a multiple description method with good speech quality, and a high-frequency part may be coded by using a multiple description method with poor speech quality. Or, the speech quality of multiple description methods for each of the frequency band parts is determined according to auditory sensitivity of human ears. A frequency band part to which human ears are sensitive is coded by using the multiple description method with good speech quality and a frequency band part to which human ears are insensitive is coded by using the multiple description method with poor speech quality.

Figure 2B:
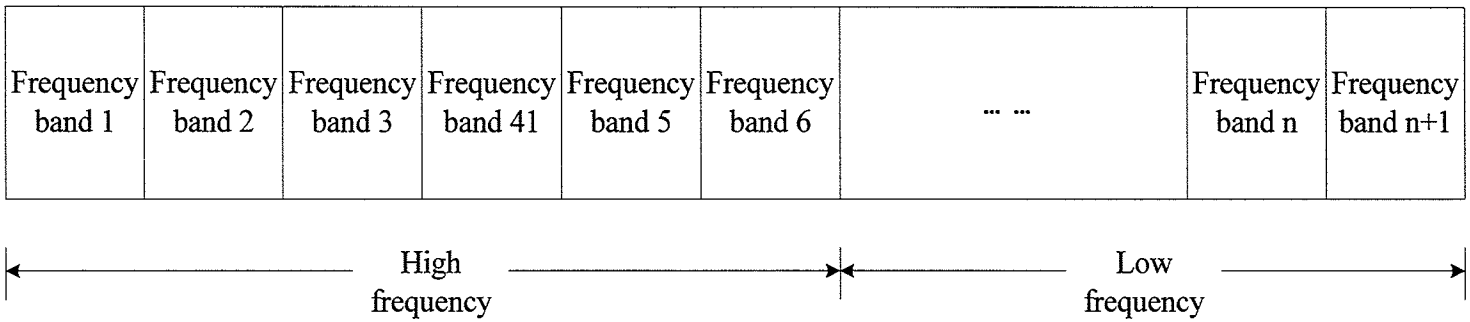
FIG. 2*b* is a schematic diagram of division of high-frequency and low-frequency parts according to Embodiment 1 of the present invention.

It should be noted that low frequency and high frequency are two relative concepts. For example, after the residual signals are divided into n+1 frequency band parts according to n frequency thresholds, one or more frequency band parts having high frequencies are taken as high-frequency parts and the remaining frequency band parts having low frequencies are taken as low-frequency parts. Details are shown in FIG. 2*b*. As shown in FIG. 2*b*, a frequency band part having high frequencies is coded by using the multiple description method with poor speech quality and a frequency band part having low frequencies is coded by using the multiple description method with good speech quality.

Each of the frequency bands may be taken as one frequency band part, and frequency band parts in descending order of frequencies are coded by using multiple description methods with ascending speech quality. To be specific, the frequency band part having the highest frequency is coded by using the multiple description method with the poorest speech quality, the speech quality of the multiple description method is increased with decrease of the frequency, and the frequency band part having the lowest frequency is coded by using the multiple description method with the best speech quality.

In addition, the multiple description method with good speech quality may be a scalar quantization multiple description method, a vector quantization multiple description method, or a matrix transform multiple description method; and the multiple description method with poor speech quality may be an odd-even separation multiple description method, or a scalar quantization multiple description method with a quantization table configured.

The main factor affecting speech quality of a multiple description method lies in redundant information after being coded by using an MDC method. To be specific, the more redundant information after being coded by using an MDC method, the better speech quality after being coded with the redundant information discarded.

Step 23: Combine each of description signal parts that are generated after coding is performed by using different MDC methods to form multiple description bit streams of the residual signals.

In step 23, after the coding in the previous step, each of the description signal parts that are generated after coding is performed by using different MDC methods may be combined to form multiple description bit streams of the residual signals. During specific implementation, masking threshold signals may be processed according to the prior art to generate multiple description bit streams of the threshold signals, and the multiple description bit streams of the threshold signals are combined with the multiple description bit streams of the residual signals to form total multiple description bit streams.

It should be noted that a decoding end may also divide the total multiple description bit streams into the multiple description bit streams of the masking threshold signals and the multiple description bit streams of the residual signals according to the prior art, and further process the multiple description bit streams of the residual signals according to the embodiments of the present invention.

During specific implementation, combining each of description signal parts that are generated after coding is performed by using different MDC methods to form multiple description bit streams of the residual signals may be specifically as follows: generating multiple low-frequency description signal parts after the frequency band parts having low frequencies are coded by using the multiple description method with good speech quality; and generating multiple high-frequency description signal parts after the frequency band parts having high frequencies are coded by using the multiple description method with poor speech quality; and then combining the generated multiple low-frequency description signal parts and high-frequency description signal parts to form multiple description bit streams.

Figure 3:
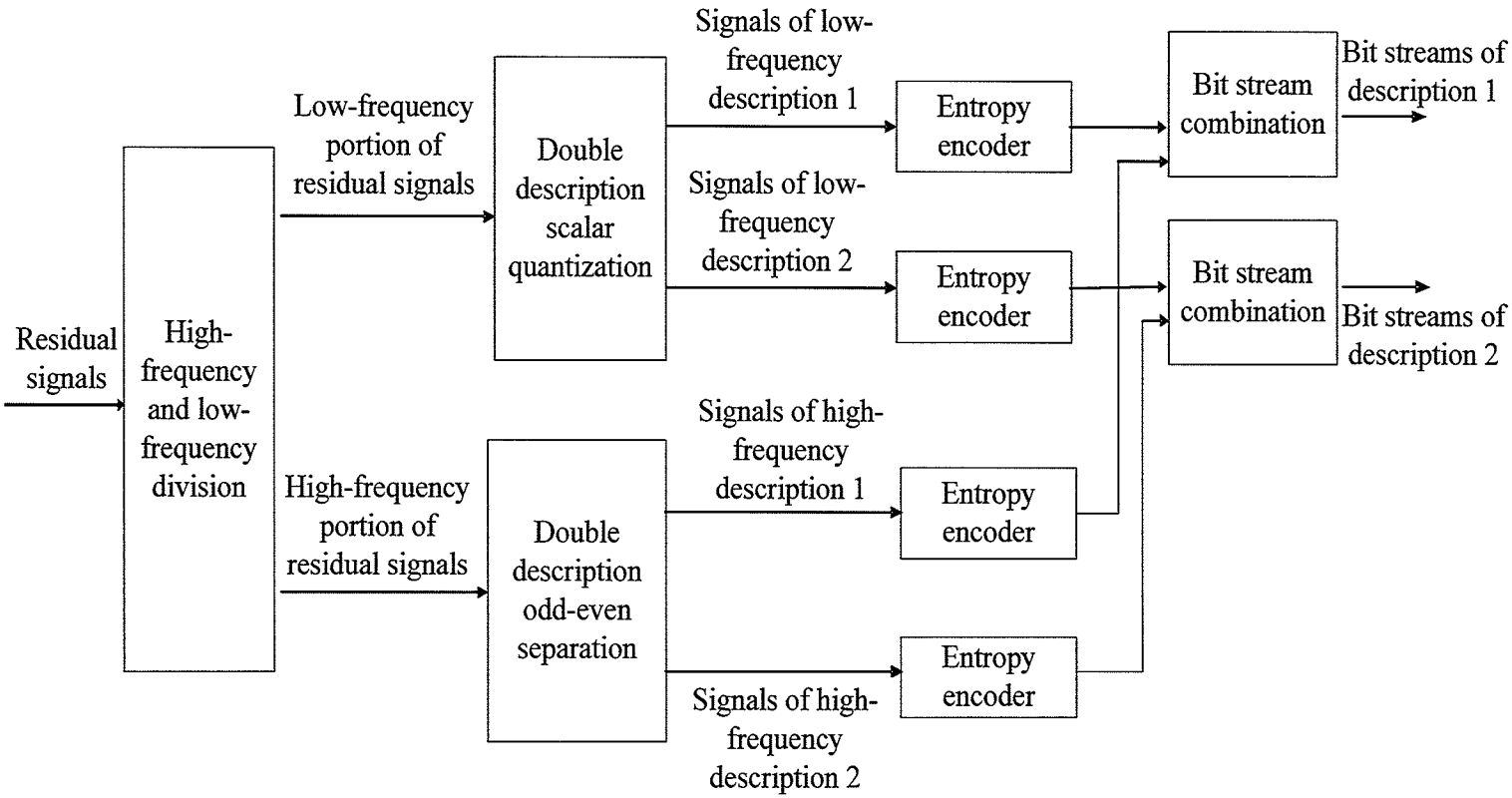
FIG. 3 is a schematic structural diagram of double description coding of residual signals according to Embodiment 1 of the present invention.

Coding performed by using a double description method is used as an example for illustration. FIG. 3 is a schematic structural diagram of double description coding of residual signals according to Embodiment 1 of the present invention. As shown in FIG. 3, the residual signals are divided into two frequency band parts (a low-frequency part and a high-frequency part); the low-frequency part is coded by using the scalar quantization description method with good speech quality to generate two low-frequency description signal parts (signals of low-frequency description 1 and signals of low-frequency description 2) and the high-frequency part is coded by using the odd-even separation description method with poor speech quality to generate two high-frequency description signal parts (signals of high-frequency description 1 and signals of high-frequency description 2); and then the generated four description signal parts are entropy-coded, the signals of low-frequency description 1 and the signals of high-frequency description 1 after entropy coding are combined to form bit streams of description 1 of the residual signals, and the signals of low-frequency description 2 and the signals of high-frequency description 2 after entropy coding are combined to form bit streams of description 2 of the residual signals.

It should be noted that, the preceding description takes the coding performed by using a double description method as an example for illustration, and during specific implementation, a more description method may be used according to actual needs, for example, a triple-description or quadruple-description method. The process of combining the multiple low-frequency description signal parts and high-frequency description signal parts that are generated after coding is performed by using a multiple description method to form the multiple description bit streams of the residual signals is similar to the above example.

According to the technical solution implemented in Embodiment 1, MDC methods with different speech quality are used for different frequency bands, which reduces the bit rate of multiple description coding, improves the effect of multiple description coding, and hence enhances the quality of audio transmission.

Embodiment 2

Figure 4:
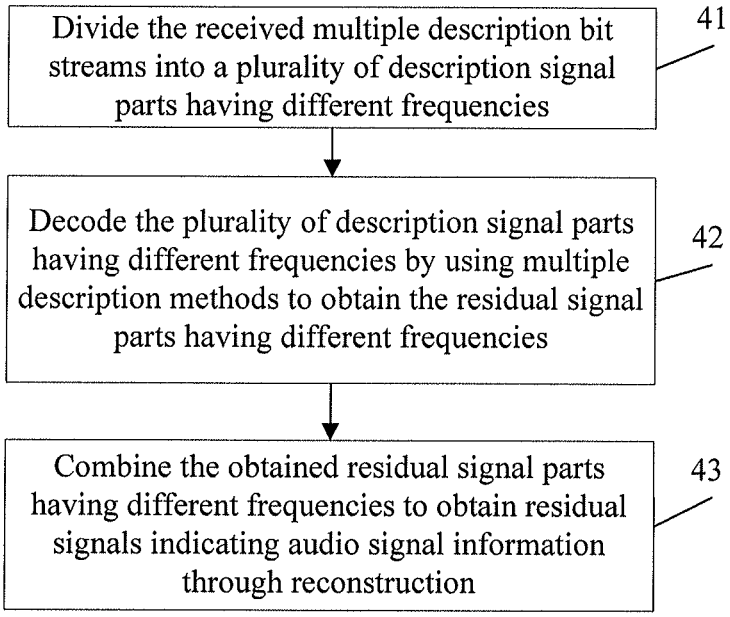
FIG. 4 is a schematic flowchart of a multiple description audio decoding method according to Embodiment 2 of the present invention.

Embodiment 2 of the present invention provides a multiple description audio decoding method. FIG. 4 is a schematic flowchart of the multiple description audio decoding method according to this embodiment. The method includes the following steps:

Step 41: Divide received multiple description bit streams of residual signals into multiple description signal parts having different frequencies.

During specific implementation, frequency band division may be performed for the received multiple description bit streams of the residual signals to divide the description bit streams into multiple low-frequency description signal parts and multiple high-frequency description signal parts. A decoding end uses a same frequency band dividing method as a coding end. For details, refer to the relevant content in Embodiment 1.

Step 42: Decode the multiple description signal parts having different frequencies by using multiple description methods to obtain residual signal parts having different frequencies.

During specific implementation, the multiple low-frequency description signal parts are decoded by using multiple description methods to obtain low-frequency parts of the residual signals and the multiple high-frequency description signal parts are decoded by using multiple description methods to obtain high-frequency parts of the residual signals. The decoding end uses the multiple description decoding method corresponding to the coding end to perform multiple description decoding. For details, refer to the relevant content in Embodiment 1.

Step 43: Combine the obtained residual signal parts having different frequencies to obtain residual signals indicating audio signal information through reconstruction.

During specific implementation, the obtained low-frequency parts of the residual signals and high-frequency parts of the residual signals may be combined and the residual signals indicating the audio signal information are obtained through reconstruction.

Figure 5:
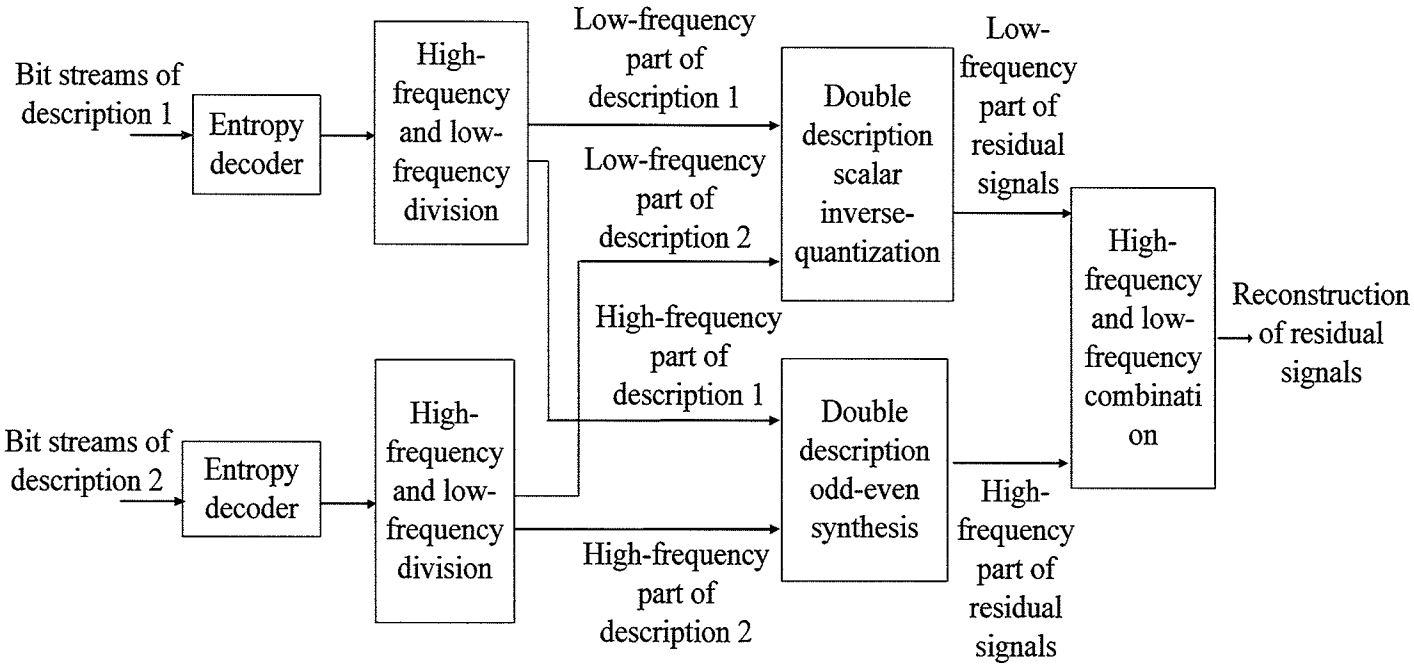
FIG. 5 is a schematic structural diagram of decoding double description bit streams according to Embodiment 2 of the present invention.

Coding and decoding performed by using the double description method are used as examples for illustration. FIG. 5 is a schematic structural diagram of decoding double description bit streams according to Embodiment 2 of the present invention. As shown in FIG. 5, the received bit streams of description 1 and bit streams of description 2 are respectively entropy-decoded and divided into high-frequency description signal parts and low-frequency description signal parts; two low-frequency description signal parts (a low-frequency part of description 1 and a low-frequency part of description 2) are decoded by using a scalar inverse-quantization method to generate the low-frequency parts of the residual signals, and two high-frequency description signal parts (high-frequency part of description 1 and high-frequency part of description 2) are decoded by using an odd-even synthesis method to generate the high-frequency parts of the residual signals; and the low-frequency and high-frequency description signal parts of the residual signals are combined to form the residual signals indicating the audio signal information through reconstruction.

It should be noted that, the preceding description takes the decoding performed by using a double description method as an example for illustration, and during specific implementation, decoding may be performed by using a multiple description method according to the multiple description method used by the coding end. For example, if the coding end uses a triple description or quadruple description method to perform coding, the decoding end uses the triple description or quadruple description method to perform decoding.

In addition, in this embodiment, if some of the multiple description bit streams are lost, only the received parts of the description bit streams need to be decoded.

Figure 6:
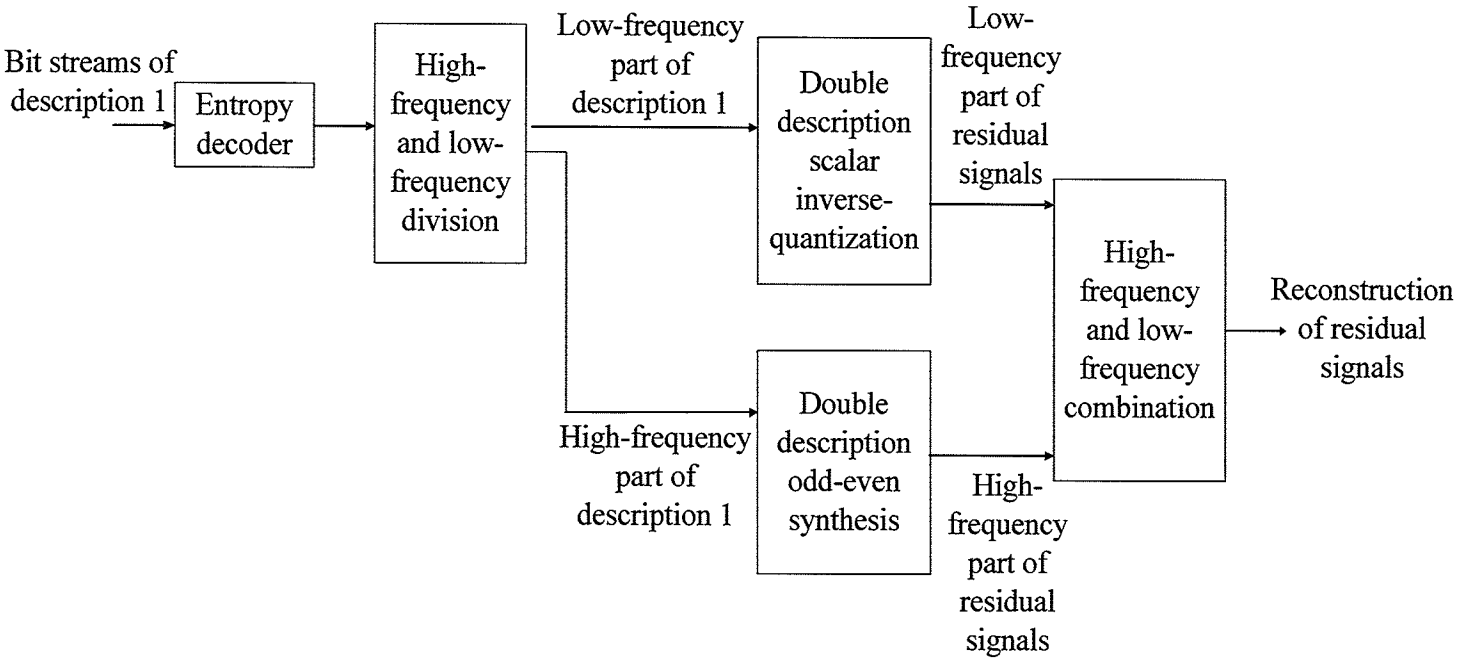
FIG. 6 is another schematic structural diagram of decoding double description bit streams according to Embodiment 2 of the present invention.

Coding and decoding performed by using the double description method are still used as examples for illustration. FIG. 6 is another schematic structural diagram of decoding double description bit streams according to Embodiment 2 of the present invention. As shown in FIG. 6, the decoding end receives only the bit streams of description 1 and the bit streams of description 2 are lost during transmission, and therefore only the bit streams of description 1 need to be entropy-decoded and divided into a high-frequency part and a low-frequency part; the low-frequency part of description 1 is decoded by using the scalar inverse-quantization method to generate the low-frequency part of the residual signals and the high-frequency part of description 1 is decoded by using the odd-even synthesis method to generate the high-frequency part of the residual signals; and then the generated low-frequency and high-frequency parts are combined to form the residual signals indicating the audio signal information through reconstruction.

According to the technical solution implemented in Embodiment 2, multiple description methods with different speech quality are used for different frequency bands, which reduces the bit rate of multiple description decoding, improves the effect of multiple description decoding, and hence enhances the quality of audio transmission.

Embodiment 3

Figure 7:
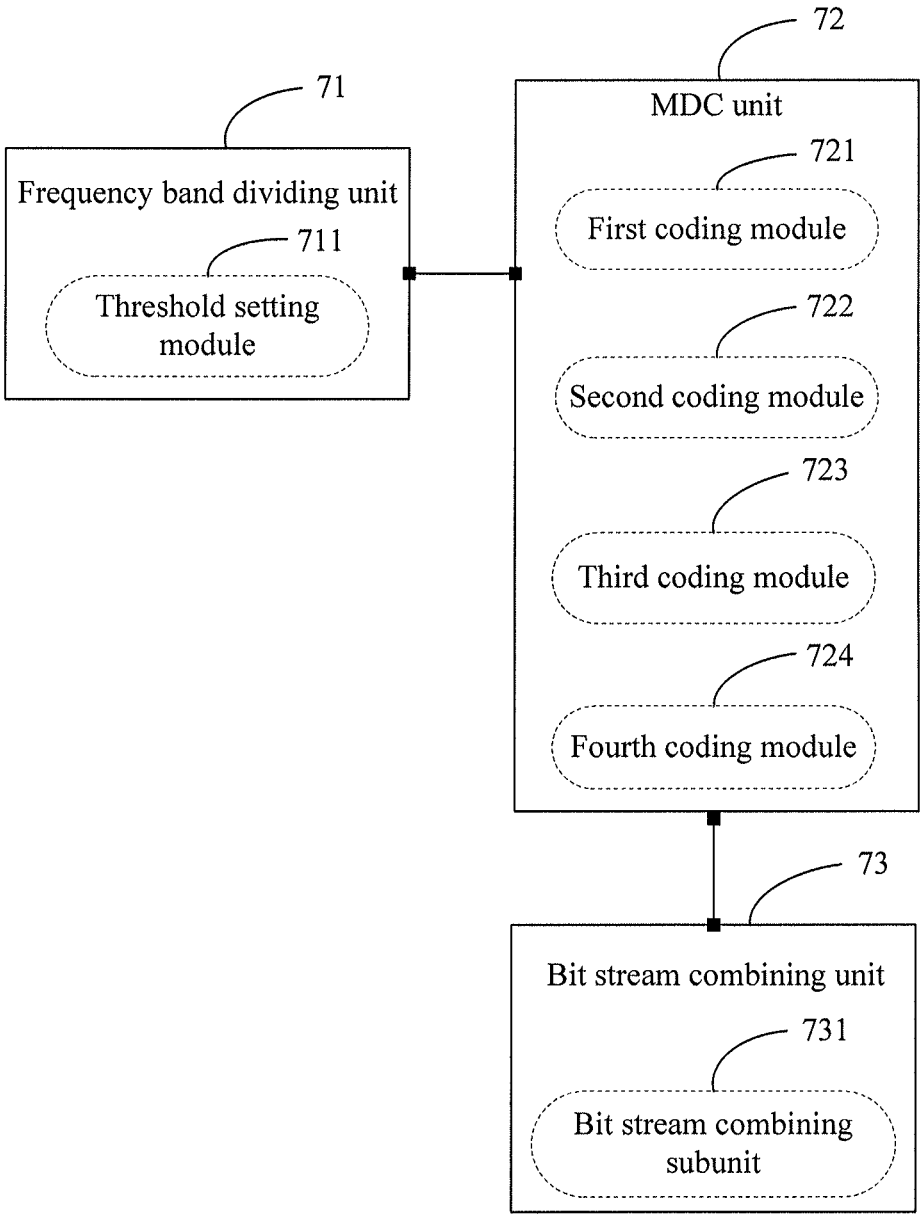
FIG. 7 is a schematic structural diagram of a multiple description audio coding apparatus according to Embodiment 3 of the present invention.

Embodiment 3 of the present invention provides a multiple description audio coding apparatus. FIG. 7 is a schematic structural diagram of the audio coding apparatus according to this embodiment. The apparatus includes a frequency band dividing unit 71, an MDC unit 72, and a bit stream combining unit 73.

The frequency band dividing unit 71 is configured to divide residual signals indicating current audio signal information into multiple frequency band parts having different frequencies. For a detailed dividing method, refer to Embodiment 1.

The MDC unit 72 is configured to code the multiple frequency band parts divided by the frequency band dividing unit by using MDC methods with different speech quality. For a detailed coding method, refer to Embodiment 1.

The bit stream combining unit 73 is configured to combine each of description signal parts that are generated after coding is performed by the MDC unit by using different MDC methods to form multiple description bit streams of the residual signals. For a detailed combination method, refer to Embodiment 1.

The MDC unit 72 codes the multiple frequency band parts to obtain multiple description signal parts corresponding to each of the frequency band parts. Then, the bit stream combining unit 73 respectively combines the multiple description signal parts corresponding to each of the frequency band parts to form multiple description bit streams of residual signals, that is, multiple description bit streams of the residual signals. Further, the frequency band dividing unit 71 may further include a threshold setting module 711. The threshold setting module 711 is configured to set more than one frequency threshold as required and divide the residual signals according to the set frequency thresholds.

In addition, the MDC unit 72 may further include a first coding module 721 and a second coding module 722. The first coding module 721 is configured to code a low-frequency part among the divided multiple frequency band parts by using a multiple description method with good speech quality; and the second coding module 722 is configured to code a high-frequency part among the divided multiple frequency band parts by using the multiple description method with poor speech quality.

The MDC unit 72 may further include a third coding module 723 and a fourth coding module 724. The third coding module 723 is configured to code a frequency band part to which human ears are sensitive among the divided multiple frequency band parts by using the multiple description method with good speech quality; and the fourth coding module 724 is configured to code a frequency band part to which human ears are insensitive among the divided multiple frequency band parts by using the multiple description method with poor speech quality.

The bit stream combining 73 may further include more than two bit stream combining subunits 731. The bit stream combining subunits 731 are configured to combine each of description signal parts that are generated after coding is performed by using different MDC methods to form more than two description bit streams of the residual signals, where the more than two description bit streams form the multiple description bit streams of the residual signals. Each bit stream combining subunit 731 combines a description signal part of each of the coded frequency band parts to form one description bit stream of the residual signals. For details, refer to the relevant descriptions in a method embodiment. According to the technical solution implemented in Embodiment 3, MDC methods with different speech quality are used for different frequency bands, which reduces the bit rate of multiple description coding, improves the effect of multiple description coding, and hence enhances the quality of audio transmission.

Embodiment 4

Figure 8:
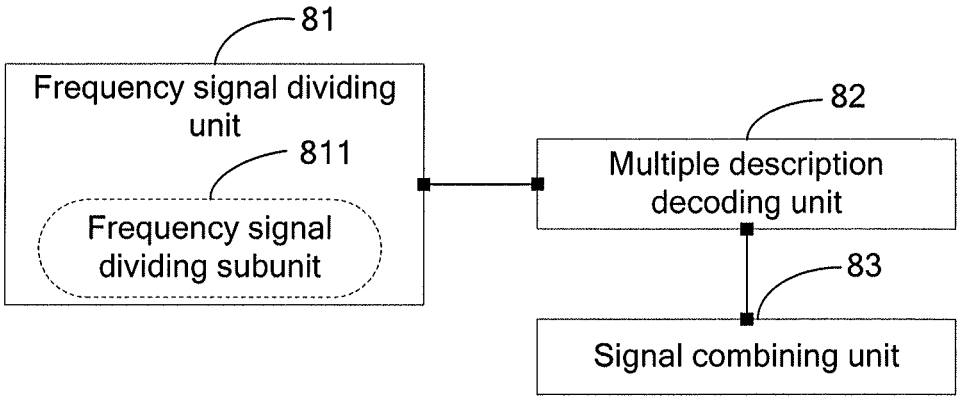
FIG. 8 is a schematic structural diagram of a multiple description audio decoding apparatus according to Embodiment 4 of the present invention.

Embodiment 4 of the present invention provides a multiple description audio decoding apparatus. FIG. 8 is a schematic structural diagram of the audio decoding apparatus according to this embodiment. The apparatus includes a frequency signal dividing unit 81, a multiple description decoding unit 82, and a signal combining unit 83.

The frequency signal dividing unit 81 is configured to divide received multiple description bit streams of residual signals into multiple description signal parts having different frequencies.

The multiple description decoding unit 82 is configured to decode the multiple description signal parts having different frequencies by using multiple description methods to obtain residual signal parts having different frequencies.

The signal combining unit 83 is configured to combine the obtained residual signal parts having different frequencies to obtain residual signals indicating audio signal information through reconstruction.

The frequency signal dividing unit 81 respectively divides the received multiple description bit streams of the residual signals, where each description bit stream is divided into multiple description signal parts having different frequencies; and the description signal parts that have a same frequency and correspond to each description bit stream are combined and output to the multiple description decoding unit 82. The multiple description decoding unit 82 decodes each of the description signal parts having the same frequency by using multiple description methods to obtain one frequency band part of the residual signals (one residual signal part having a specific frequency); and then the multiple description decoding unit 82 respectively decodes the description signal parts having different frequencies by using multiple description methods to obtain frequency band parts of the residual signals (residual signal parts having different frequencies). Finally, the signal combining unit 83 combines each of the frequency band parts of the residual signals to obtain the residual signals through reconstruction.

In addition, the frequency signal dividing unit 81 may include more than two frequency signal dividing subunits 811. The frequency signal dividing subunits 811 are configured to divide the received multiple description bit streams into multiple description signal parts having different frequencies. Each frequency signal dividing subunit 811 divides one description bit stream into different description signal parts having different frequencies. For details, refer to the relevant descriptions in a method embodiment.

Similarly, according to the technical solution implemented in Embodiment 4, multiple description decoding methods with different speech quality are used for different frequency bands, which reduces the bit rate of multiple description decoding, improves the effect of multiple description decoding, and hence enhances the quality of audio transmission.

Embodiment 5

Figure 9:
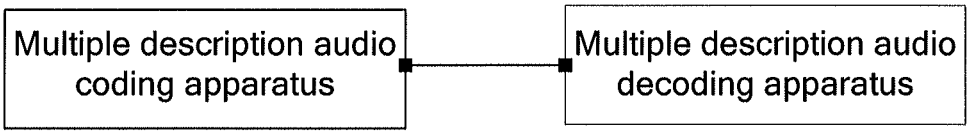
FIG. 9 is a schematic structural diagram of a multiple description audio coding and decoding system according to a fifth embodiment of the present invention.

This embodiment provides a multiple description audio coding and decoding system. FIG. 9 is the schematic structural diagram of an audio coding and decoding system according to this embodiment. The system includes the multiple description audio coding apparatus according to Embodiment 3 and the multiple description audio decoding apparatus according to Embodiment 4.

It should be noted that the units described in the above apparatus and system embodiments are divided only according to the function logic but are not limited thereto. Units that can implement corresponding functions are also applicable. In addition, names of the functional units are for differentiation only and therefore are not intended to limit the scope of the present invention.

Persons skilled in the art understand that all or part of the steps of the preceding methods can be implemented by hardware following instructions of programs. The programs may be stored in a computer readable storage medium. The storage medium may be a read only memory (ROM), a magnetic disk, or a compact disk-read only memory (CD-ROM).

In conclusion, according to embodiments of the present invention, multiple description coding and decoding methods with different speech quality are used for different frequency bands, which reduces the bit rate of multiple description coding and decoding, improves the effect of multiple description coding and decoding, and hence enhances the quality of audio transmission.

Detailed above are merely exemplary embodiments of the present invention, but the scope of the present invention is not limited thereto. Variations or replacements readily apparent to persons skilled in the prior art within the scope of the technology disclosed herein shall fall within the scope of the present invention. Therefore, the protection scope of the present invention is subjected to the appended claims.

What is claimed is:

1. A multiple description audio coding method, comprising:

dividing residual signals indicating current audio signal information into multiple frequency band parts having different frequencies;

respectively coding the multiple frequency band parts by using multiple description coding (MDC) methods with different speech quality; and combining each of description signal parts that are generated after coding is performed by using different MDC methods to form multiple description bit streams of the residual signals.

2. The method according to claim 1, wherein the dividing residual signals indicating current audio signal information into multiple frequency band parts comprises:

setting more than one frequency threshold; and dividing the residual signals into multiple frequency band parts according to the set more than one frequency threshold.

3. The method according to claim 1, wherein the respectively coding the multiple frequency band parts by using MDC methods with different speech quality comprises one of:

among the divided multiple frequency band parts, coding frequency band parts having low frequencies by using a multiple description method with good speech quality and coding frequency band parts having high frequencies by using a multiple description method with poor speech quality; and among the divided multiple frequency band parts, coding a frequency band part to which human ears are sensitive by using a multiple description method with good speech quality and coding a frequency band part to which human ears are insensitive by using a multiple description method with poor speech quality.

4. The method according to claim 3, wherein:

the multiple description method with good speech quality comprises: a scalar quantization multiple description method, a vector quantization multiple description method, or a matrix transform multiple description method; and the multiple description method with poor speech quality comprises: an odd-even separation multiple description method.

5. The method according to claim 1, wherein the combining each of description signal parts that are generated after coding is performed by using different MDC methods to form multiple description bit streams of the residual signals comprises:

generating multiple low-frequency description signal parts after frequency band parts having low frequencies are coded by using a multiple description method with good speech quality; and generating multiple high-frequency description signal parts after frequency band parts having high frequencies are coded by using a multiple description method with poor speech quality; and combining the generated multiple low-frequency description signal parts and high-frequency description signal parts to form multiple description bit streams of the residual signals.

6. A multiple description audio decoding method, comprising:

dividing received multiple description bit streams of residual signals into multiple description signal parts having different frequencies;

decoding the multiple description signal parts having different frequencies by using multiple description methods to obtain residual signal parts having different frequencies; and combining the obtained residual signal parts having different frequencies to obtain residual signals indicating audio signal information through reconstruction.

7. The method according to claim 6, wherein when the multiple description signal parts having different frequencies comprise low-frequency description signal parts and high-frequency description signal parts, the method specifically comprises:

dividing the received multiple description bit streams of the residual signals into the low-frequency description signal parts and the high-frequency description signal parts;

decoding the low-frequency description signal parts by using multiple description methods to obtain low-frequency parts of the residual signals and decoding the high-frequency description signal parts by using multiple description methods to obtain high-frequency parts of the residual signals; and combining the obtained low-frequency parts of the residual signals and high-frequency parts of the residual signals to obtain the residual signals indicating the audio signal information through reconstruction.

8. The method according to claim 6, further comprising:

decoding received parts of description bit streams if some of the multiple description bit streams are lost.

9. A multiple description audio coding apparatus, comprising:

a frequency band dividing unit, configured to divide residual signals indicating current audio signal information into multiple frequency band parts having different frequencies;

a multiple description coding (MDC) unit, configured to respectively code, by using MDC methods with different speech quality, the multiple frequency band parts divided by the frequency band dividing unit; and a bit stream combining unit, configured to combine each of description signal parts that are generated after coding is performed by the MDC unit by using different MDC methods to form multiple description bit streams of the residual signals.

10. The apparatus according to claim 9, wherein the frequency band dividing unit comprises:

a threshold setting module, configured to set more than one frequency threshold and divide the residual signals according to the set frequency thresholds.

11. The apparatus according to claim 9, wherein the MDC unit comprises:

a first coding module, configured to code a low-frequency part among the divided multiple frequency band parts by using a multiple description method with good speech quality; and a second coding module, configured to code a high-frequency part among the divided multiple frequency band parts by using a multiple description method with poor speech quality.

12. The apparatus according to claim 9, wherein the MDC unit further comprises:

a third coding module, configured to code a frequency band part to which human ears are sensitive among the divided multiple frequency band parts by using a multiple description method with good speech quality; and a fourth coding module, configured to code a frequency band part to which human ears are insensitive among the divided multiple frequency band parts by using a multiple description method with poor speech quality.

13. The apparatus according to claim 9, wherein the bit stream combining unit comprises:

more than two bit stream combining subunits, configured to combine each of description signal parts that are generated after coding is performed by using different MDC methods to form multiple description bit streams of the residual signals;

wherein each bit stream combining subunit combines one description signal part of each of frequency band parts after being coded to form a description bit stream of the residual signals.

14. A multiple description audio decoding apparatus, comprising:

a frequency signal dividing unit, configured to divide received multiple description bit streams of residual signals into multiple description signal parts having different frequencies;

a multiple description decoding unit, configured to decode the multiple description signal parts having different frequencies by using multiple description methods to obtain residual signal parts having different frequencies; and a signal combining unit, configured to combine the obtained residual signal parts having different frequencies to obtain residual signals indicating audio signal information through reconstruction.

15. The apparatus according to claim 14, wherein the frequency signal dividing unit comprises:

more than two frequency signal dividing subunits, configured to divide the received multiple description bit streams of residual signals into multiple description signal parts having different frequencies;

wherein each frequency signal dividing subunit divides one description bit stream into multiple description signal parts having different frequencies.

16. A multiple description audio coding and decoding system, comprising a multiple description audio coding apparatus and a multiple description audio decoding apparatus, wherein the multiple description audio coding apparatus, comprises:

a frequency band dividing unit, configured to divide residual signals indicating current audio signal information into multiple frequency band parts having different frequencies;

a multiple description coding (MDC) unit, configured to respectively code, by using MDC methods with different speech quality, the multiple frequency band parts divided by the frequency band dividing unit; and a bit stream combining unit, configured to combine each of description signal parts that are generated after coding is performed by the MDC unit by using different MDC methods to form multiple description bit streams of the residual signals; and wherein the multiple description audio decoding apparatus, comprising:

a frequency signal dividing unit, configured to divide received multiple description bit streams of residual signals into multiple description signal parts having different frequencies;

a multiple description decoding unit, configured to decode the multiple description signal parts having different frequencies by using multiple description methods to obtain residual signal parts having different frequencies; and a signal combining unit, configured to combine the obtained residual signal parts having different frequencies to obtain residual signals indicating audio signal information through reconstruction.

17. The multiple description audio coding and decoding system according to claim 16, wherein the MDC unit comprises:

a first coding module, configured to code a low-frequency part among the divided multiple frequency band parts by using a multiple description method with good speech quality; and a second coding module, configured to code a high-frequency part among the divided multiple frequency band parts by using a multiple description method with poor speech quality.

18. The multiple description audio coding and decoding system according to claim 16, wherein the bit stream combining unit comprises:

more than two bit stream combining subunits, configured to combine each of description signal parts that are generated after coding is performed by using different MDC methods to form multiple description bit streams of the residual signals;

wherein each bit stream combining subunit combines one description signal part of each of frequency band parts after being coded to form a description bit stream of the residual signals.

19. The multiple description audio coding and decoding system according to claim 16, wherein the frequency signal dividing unit comprises:

more than two frequency signal dividing subunits, configured to divide the received multiple description bit streams of residual signals into multiple description signal parts having different frequencies;

wherein each frequency signal dividing subunit divides one description bit stream into multiple description signal parts having different frequencies.

* * * * *